US006247697B1

(12) United States Patent
Jewett

(10) Patent No.: US 6,247,697 B1
(45) Date of Patent: Jun. 19, 2001

(54) MELDING CARD GAME

(76) Inventor: Carol A. Jewett, 58 Oxhorn Rd., Wiscasset, ME (US) 04578

( * ) Notice: Subject to any disclaimer, the term of this patent is extended or adjusted under 35 U.S.C. 154(b) by 0 days.

(21) Appl. No.: 09/351,981

(22) Filed: Jul. 12, 1999

(51) Int. Cl.[7] ..... A63F 1/00

(52) U.S. Cl. ..... 273/292

(58) Field of Search ..... 273/292, 303, 273/306, FOR 292

(56) References Cited

U.S. PATENT DOCUMENTS 5,816,576 * 10/1998 Aramapakul .

OTHER PUBLICATIONS

"The way to play" by Diagram Group p. 110, 1976.*

* cited by examiner

*Primary Examiner*—Benjamin H. Layno
*Assistant Examiner*—Vishu K. Mendiratta
(74) *Attorney, Agent, or Firm*—Charles F. Seyboldt

(57) ABSTRACT

A melding card game that is played in rounds of an initial turn of card trading and subsequent turn of card drawing and discarding is disclosed. Card trading and drawing is facilitated by the presence of at least one face-up card in front of each player, and the presence of a common discard pile. In addition, the deck has one or more special-effects cards that permit the holder to trade all or some of the cards in his or her hand with cards from each of the other players. When one player has accumulated a qualifying combination of cards, he or she declares the round over, and point values are determined for each player's hand. Additional rounds may be played until one player has accumulated a predetermined number of points.

12 Claims, No Drawings

MELDING CARD GAME

BACKGROUND OF THE PRESENT INVENTION SUMMARY OF THE PRIOR ART

This invention relates to a melding card game, and more particularly to a melding card game using a special deck, wherein the sequence of play of a round includes a first turn having one set of rules and subsequent turns having a different set of rules, and wherein the deck includes multiple sets of matching (meldable) cards and includes at least one species of "special-effects" card, and wherein the rules provide that the "special-effects" card is playable according to a unique set of rules. Even more particularly, a medieval theme is described that is appealing to many players.

U.S. Pat. No. 814,996, to C. Warne, discloses a deck of cards wherein no specific card is duplicated within a deck. Each card has a "name" (e.g. King, Queen, Castle, Knight) or a number value; a "suit" (e.g. Pawn and Page); and a "division" (e.g. crowned and uncrowned). Further, the deck may include a "Jester" card, which is not associated with any suit or division. The inventor also discloses rules for playing a card game for two people (or two teams of two people), wherein the play begins with the dealer choosing his or her suit, then dealing the cards. Play then proceeds in "tricks" with mandatory following of suit. The playing of specified combinations of same-suited number cards within a trick gives rights to face cards, which are placed in the hand of the person who made the specific number card combination, When one player has exhausted his or her supply of number cards, all players discard all number cards, and all players discard all face cards that are not of their suit. Play resumes from these face-card-only hands, where the higher value of face card takes the trick, and the object is to take the greatest number of tricks.

U.S. Pat. No. 5,374,067 to D. A. Jones discloses a gambling game that may be played with a conventional deck of cards (i.e. a deck having thirteen cards, ace through king, in each of four suits, clubs, diamonds, hearts and spades). The disclosed game contemplates a number of players against the "house." In five card hands, the object is to have low residual points. In figuring the residual points, no card that makes up a three to five card same-suited run or a three or four card match is counted. That is, 4-5-6 of the same suit makes a three card same-suited run therefore these cards are not included in the residual point determination, similarly, 5-5-5 of different suits makes a three card match. Each player's residual point value is compared against the residual point value of the house, and when a player has fewer residual points than the house, the player wins the bet. Lower residual points result in increasing payoff amounts, according to an odds table that relates residual points to payoff odds.

U.S. Pat. No. 5,887,873 to J. Freeman discloses a deck of cards wherein each card may be characterized with three different attributes. For example, a card may be characterized as 1) being within a suit, 2) being within a color group, and 3) having a value. The specification describes one specific deck as having three different suits, three different colors, and six different values, making a deck of 54 cards (3×3×6). Various other decks are disclosed, including the presence of auxiliary or "joker" cards (column 8, line 23).

The use of playing cards, or tiles, or their equivalent as represented on a computer screen, for entertainment is well known and widely practiced. Many games have been developed that involve the use of a standard deck of cards, and many games have been developed that involve the use of special decks of cards.

More specifically, many card games involve the melding of cards in order to arrive at a score. For example "Go Fish" is a game that rewards a player who collects all of the cards of a given value. Pinochle and Rummy (and Gin) are also examples of card games where certain collections of cards are accorded points.

Further, many card games provide for the use of a "wild" or "joker" card or cards within their rules. For example, the game of "old Maid" has one card, the "Old Maid", that is shunned by the players. Also, it is well known to permit a "wild" or "joker" card to act as a stand-in for any other card in the deck, thereby permitting a player who is holding a "wild" card to declare the most advantageous hand.

Many card games using special decks and rules have been developed. For example, "Mille Borne" and "Rook" are games that rely on unconventional decks in order to facilitate the playing of various games.

SUMMARY OF THE PRESENT INVENTION

The present invention is a card game that is easy to learn, yet unpredictable in its play. The game according to the present invention also involves a certain amount of strategy, as there is no obligation on a player who may qualify to end a round to do so, and all players can infer a certain amount of information about every player's hand, and all players have an opportunity to engage in trading cards of all of the other players.

The game may be played with any number of players, depending on the size of the deck, but as discussed below, is intended for from two (2) to four (4) players.

The present invention discloses a melding card game that may be played using a special deck of cards. Most of the deck consists of sets of matching cards, for example, four (4) each of twelve (12) different values may be provided to make up forty-eight (48) cards of deck. The deck also includes a relatively small number of cards that may be played to "special effect." The "special effect" card contemplated is not equivalent to the conventional "wild" card or "joker" card that is commonly used as a stand-in to represent any card in a melding or point-earning combination. For example, three (3) "special effect" cards may be added to complete the above-described deck with a total of fifty-one (51) cards. A deck may optionally include a relatively small number of "wild" cards that a player may use to qualify for ending a round of play.

The rules allow limited card trading, under the control of each player in turn, with the primary object of each round being to accumulate sets of matching cards. A player holding a "special-effects" card is permitted to exercise more extensive trading powers. In the preferred embodiment, a player may not play a "special effects" card if it is in the face-up position at the start of their turn.

One person is selected to be the first dealer, and deals a number of cards face down to each player and one card face-up to each player (n.b. the dealer is one of the players). The dealer then places the remaining deck face down near the center of the playing table, and turns the top card of the remaining deck (or any random card) face-up to begin a discard pile.

Play proceeds in rotation, in which, by card game convention, play moves "to the left." The game proceeds in "rounds."

Each round is characterized as having a first turn for each player, and subsequent turns for each player. The rules for the first turn of play are different from the rules for subsequent turns. In the first turn, players are permitted to trade among their face-up cards and the discard pile. In subsequent turns, players draw and discard, or, if they have a "special effects" card, instead of drawing from the remaining deck, they may perform extensive trading between their hand and the other players' cards.

A round ends when one player "melds" or declares that he or she has the requisite combination of cards to qualify for ending the round. For example, the rules may permit a player who has two pairs, or one pair and three of a kind, or four of a kind, or more (e.g. two pair plus four of a kind) to declare the end of the round. In the preferred embodiment, the rules exclude the face-up cards from the meld. At the end of a round, each player's hand is given a point value, according to the cards held.

After each round, the deal is passed to the next person in rotation, and play continues as described above. A game is intended to consist of playing an indeterminate number of rounds until one person has accumulated a predetermined number of points that constitutes declaring that person the winner, but alternatively, the person having the most points after playing a predetermined number of rounds could be declared the winner.

The present invention relates to a melding card game that may be adapted to decks having various numbers of cards, or to various themes. Specific features of the invention will be apparent from the above and from the following description of the illustrative embodiments when considered with the attached drawings and the appended claims.

In summary, and in accordance with the above discussion, the foregoing objectives are achieved in the following embodiments.

1. A method of playing a melding card game comprising the following steps:

providing a deck of playing cards including a plurality of different melding card values and having a plurality of cards of each melding card value, and including one ox more special-effects cards;

dealing a plurality of cards face-down to each player;

dealing at least one card face-up to each player;

placing the remaining deck face-down and turning at least one card from the remaining deck face-up to begin a common discard pile;

beginning a round wherein each player in rotation has a first turn where each player is allowed to trade a card according to a first set of rules;

playing subsequent turns where each player in rotation is allowed to draw and discard according to a second set of rules, where the second set of rules specifies the use of the special-effects card, where the second set of rules also specifies the conditions whereby one player may end the round, where the conditions for ending the round includes a requirement for holding a certain combination of cards; and after the round is ended, assigning point values to each player according to a set of point-assignment rules.

2. A method of playing a melding card game, as described in paragraph 1, wherein the rules for playing the first turn may permit each player to trade any card or only specified cards for any card or only specified cards of another player or for the top card of the common discard pile, and where a player may not trade his or her card for the face-up card of any player preceding him or her in the rotation when the earlier player has traded his or her face-up card;

wherein the rules for playing the second and subsequent turns specify that each player may take at least one card from the common discard pile and/or take at least one card from the remaining deck, or if a player has a special-effects card, it may be played instead of taking a card;

wherein the rules specify that the player of a special-effects card may take a card from at least one other player and replace it with another;

wherein the rules require each player to have one card face-up and to discard another card face-up, not necessarily to the common discard pile, in order to end his or her turn;

wherein the rules specify that a player may end the round after ending his or her turn) by having at least two pairs of matching melding cards; and wherein the point assignment rules are applied to every player, and give positive value for the presence of matching melding cards and give negative value for the presence of unmatched melding cards.

3. A method of playing a melding card game, as described in paragraph 2, but wherein the rules for playing the first turn specify that each player may trade only his or her face-up card for the face-up card of another player or for the top card of the common discard pile, and where a player may not trade his or her face-up card for the face-up card of any player preceding him or her in the rotation;

wherein the rules for playing the second and subsequent turns specify that the player of a specialeffects card may take the face-up card of at least one other player;

wherein the rules specify that each player must discard to the top of the common discard pile in order to end his or her turn; and wherein the rules specify that no player may use his or her face-up card for melding.

4. A method of playing a melding card game, as described in paragraph 2, wherein the deck of playing cards further includes one or more of wild cards; and wherein the wild cards may be used to satisfy the conditions for ending the round.

5. A method of playing a melding card game, as described in paragraph 2, wherein the rules for playing the second and subsequent turns permit a player to take his or her own face-up card and replace it with a card from his or her hand before ending his or her turn; and wherein a player may not play a special-effects card from the face-up position.

6. A method of playing a melding card game, as described in paragraph 3, wherein the deck of playing cards further includes one or more wild cards; and wherein the wild cards may be used to satisfy the conditions for ending the round.

7. A method of playing a melding card game, as described in paragraph 3, wherein the rules for playing the second and subsequent turns permit a player to take his or her own face-up card and replace it with a card from his or her hand before ending his or her turn; and wherein a player may not play a special-effects card from the face-up position.

8. A method of playing a melding card game, as described in paragraph 3, wherein the deck of playing cards further includes one or more wild cards and the wild cards may be used to satisfy the conditions for ending the round;

wherein the rules for playing the second and subsequent turns permit a player to take his or her own face-up card and replace it with a card from his or her hand before ending his or her turn, and wherein a player may not play a special-effects card from the face-up position; and wherein the rules specify that after one player has satisfied the conditions for ending the round, each other player is allowed one final turn before the assigning of point values.

9. A method of playing a melding card game, as described in paragraph 8, wherein the deck of playing cards includes ten or more melding card values, and has four or more cards of each value;

wherein the rules for playing the second and subsequent turns require a player to begin each subsequent turn by taking two or more cards from a combination of the remainder of the deck and the common discard pile or by playing a special-effects card;

wherein the rules specify that a player may end the round after ending his or her turn, by having four or more cards in the meld, for example two pairs, or three of a kind and one pair, or four of a kind; and wherein the point assignment rules give more value to three of a kind than to a pair, and more value to four of a kind than to three of a kind.

10. A kit for playing a melding card game comprising:

a deck of playing cards including a plurality of different melding card values and having a plurality of cards of each melding card value, and including one or more special-effects cards; and a set of instructions for playing a melding card game, wherein the instructions specify a) dealing a plurality of cards face-down to each player;

b) dealing at least one card face-up to each player;

c) placing the remaining deck face-down and turning one card from the remaining deck face-up to begin a common discard pile;

d) beginning a round wherein each player in rotation has a first turn where each player is allowed to trade a card according to a first set of rules;

e) playing subsequent turns where each player in rotation is allowed to draw and discard according to a second set of rules, where the second set of rules specifies the use of the special-effects card, where the second set of rules also specifies the conditions whereby one player may end the round, where the conditions for ending the round includes a requirement for holding a certain combination of cards;

f) after the round is ended, assigning point values to each player according to a set of point-assignment rules.

11. A kit for playing a melding card game, as described in paragraph 10, wherein the instructions for playing the first turn may permit each player to trade any card or only specified cards for any card or only specified cards of another player or for the top card of the common discard pile, and where a player may not trade his or her card for the card of any player preceding him or her in the rotation when the earlier player has traded his or her face-up card;

wherein the instructions for playing the second and subsequent turns specify that each player may take at least one card from the common discard pile and/or take at least one card from the remaining deck, or if a player has a special-effects card, it may be played instead of taking a card;

wherein the instructions specify that the player of a special-effects card may take a card from at least one other player and replace it with another;

wherein the instructions require each player to have one card face-up and to discard another card face-up, not necessarily to the common discard pile, in order to end his or her turn;

wherein the instructions specify that a player may end the round after ending his or her turn, by having at least two pairs of matching melding cards; and wherein the point assignment rules are applied to every player, and give positive value for the presence of matching melding cards and give negative value for the presence of unmatched melding cards.

12. A kit for playing a melding card game, as described in paragraph 11, but wherein the instructions for playing the first turn specify that each player may trade only his or her face-up card for the face-up card of another player or for the top card of the common discard pile, and where a player may not trade his or her face-up card for the face-up card of any player preceding him or her in the rotation;

wherein the instructions for playing the second and subsequent turns specify that the player of a special-effects card may take the face-up card of at least one other player;

wherein the instructions specify that each player must discard to the top of the common discard pile in order to end his or her turn; and wherein the instructions specify that no player may use his or her face-up card for melding.

DESCRIPTION OF THE PREFERRED EMBODIMENTS OF THE PRESENT INVENTION

The preferred deck comprises fifty-four (54) cards. The preferred deck includes four (4) each of twelve (12) different values of cards, with their values being denominated King, Queen, Prince, Princess, Knight, Jester, Castle, Crown, Shield, Throne, Flag and Horse. However, any theme could be used to denominate different values, such as the numerals "1" through "10" or the letters "A" through "L" or a series of jungle animals, or a series of extinct animals, etc. In the scoring rules that are described below, these cards have equal point value, that is, there is no rank ordering among the values. However, it is contemplated that variations of the game could be played wherein the point values vary, depending on a rank ordering (or grouping or other scheme) among the cards.

The preferred deck also includes three (3) wild cards, which are denominated Dragon, and three (3) special effects cards, which are denominated Wizard. There need not be any distinction within each denomination of card, that is, each King may have the same appearance as every other King, and so forth. In addition, the special-effects cards and the wild cards may be given fanciful names, and in one embodiment, are known as "Poof" the Wizard and "Paloop" the Dragon, respectively. It has been found that children are responsive to requests to play the game called "Paloop," although the fanciful name given to this game is not considered to be inventive in nature.

The number of values within the deck, and the number of cards of each given value, and the number of special-effects cards, and the number of optional wild cards may all be varied, while still practicing the invention according to the present disclosure. The only restrictions are that the rules provide a scheme for melding that can be accomplished by the cards in the deck, and that the special-effects card or cards provide an effect that does not directly contribute to the meld, i.e. the special-effects card or cards do not act as traditional wild cards by matching or representing any of the meldable cards, rather, the special effects cards may be used to acquire possibly meldable cards according to a set of special-effects rules.

In the preferred embodiment, after a first dealer has been selected and has shuffled the complete deck, each player, including the dealer, is dealt three cards face-down and one card face-up. The face-down cards become the players' hands. The number of three cards in the hand is one card less than the minimum number of cards necessary for any player to declare the end of the round, according to the preferred embodiment, but this configuration is not the only way to practice the present invention.

Alternative dealing rules may provide for a fewer or greater number of face-down cards, and/or for a greater number of and face-up cards, and alternative rules for melding may permit a player to meld with fewer than four cards, or may require more than four cards for a meldable combination. Any of these variations are considered to be within the scope of the present invention.

The first turn involves only the trading of cards, no player may declare the round over until after each player has taken his or her first turn. One variation of the preferred embodiment includes a rule that penalizes a player for looking at his or her face-down cards (hand) before previous players in rotation have completed their first turns. According to the rules of the preferred embodiment, in their first turn, each player may, after viewing his or her face-down cards (hand), elect to trade his or her face-up card with the face-up card of any other player, or with the top card on the discard pile. In one version of the game, a condition for trading is that the player must have a card in his or her hand that matches the card he or she is taking in trade (a player is always allowed to take a wild card or a special-effects card in trade, even without having a match). In the first turn, a player may alternatively "pass," i.e. either be unqualified or decide not to trade his or her face-up card. But, a player may not trade his or her face-up card with any player preceding him or her in the rotation. Therefore, once a player has selected among the eligible trading cards, his selection is preserved. Also, under the preferred rules, the dealer will only be permitted to trade his or her face-up card with the top card in the discard pile, because all of the other players have preceded the dealer in the rotation.

While the above describes the preferred first turn trading rules, other first turn trading rules may be practiced within the scope of the invention. When playing the game with young children, the penalty for viewing the hand before the player's turn can be omitted. Further, it is contemplated that a player may be permitted to trade unconditionally, i.e. without having a matching card in his or her hand. Also, for example, an alternative rule set would permit a player to trade any card, including any card from his or her hand, for the face-up card of another player or the discard pile, and not be restricted to trading only his or her face-up card. An additional rule contemplated would be to permit following players to trade for the face-up card of any player who traded a card from his or her hand, i.e. a player who makes a first round trade from his or her hand may still have his or her face-up card taken by a following first turn player.

In the preferred embodiment, in subsequent turns, each player is required to draw two cards, or to play a special effects card. If the player elects to draw, one of the two cards drawn may be the top card from the discard pile, and the second would come from the remainder of the deck. In the alternative, a player may choose to take two cards from the remainder of the deck. In order to maximize the uncertainty, a player is not permitted to view the first card from the remainder of the deck before deciding whether to take the second card from the discard pile or from the remainder of the deck. That is, once a player has viewed the first card from the remainder of the deck, the second card drawn must be an unknown card from the remainder of the deck. As will be described below, a player is required to discard one card in order to end his or her turn. The combination of drawing two cards and discarding one card per turn results in an increasing number of cards in each player's hand as the round progresses. This has two effects, first, it increases the probability that any player will meet the conditions for declaring the end of the round, and, second, it increases the variability of assigned point values among the players (i.e. the possibility of low, negative scores as well as the possibility of high positive scores increases as the number of cards in the hand approaches the number of values in the deck).

While the preferred embodiment of the subsequent turn rules requires a player to draw two cards (or play a special-effects card), other drawing rules may be practiced within the scope of the present invention. For example, a player may be required to draw only one card, or may be required to draw more than two cards, or may be allowed to play a special-effects card immediately if it is the first card drawn. In yet another variant, a player may be required to draw, even if that player also elects to play a special-effects card during his or her turn. In yet another variant, a player may be permitted to draw multiple cards from the discard pile.

The practice of the present invention requires the presence of special-effects cards. The preferred rules for playing a special effects card provide that the player of a special effects card is permitted to take the face-up cards of all of the other players, and replace each with a card from his or her hand. A further restriction in the preferred embodiment is that a special effects card may only be played from the hand, i.e. not from the face-up position. The player would show the special-effects card to the other players before taking their face-up cards and replacing them, or re-arranging them. The use and play of these special-effects cards provides a significant amount of uncertainty to all of the players, and gives a significant advantage to the player who has a special-effects card. The uncertainty and advantage of the special-effects card are markedly greater than the uncertainty and advantage attributable to an "ordinary" wild card.

Alternative rules for the play of the special-effects card are contemplated to be within the scope of the present invention. For example, the rules may permit a player to play a special-effect card directly from its face-up position, rather than requiring the player to take the face-up special-effects card into his or her hand and wait for the next turn before playing it. Further, the power of the special-effects card may be modified, so that its holder is permitted to take either the face-up card, or a randomly selected card from each player's hand, or a combination thereof. Alternatively or additionally, the rules may require that if the player of a special-effects card takes a card from another player's hand, he or she must not only take it, but also view it and replace it, before taking and re-arranging any face-up cards. Under these rules, a player who is subject to the power of a special-effects card may have his or her face-up card traded, or may have a random card traded from his or her hand, but not both. In yet another variation, the player of a special-effects card may be permitted to draw multiple cards from the remainder of the deck, and replace then with cards from his or her hand.

In the preferred embodiment, a player is permitted within his or her turn to place his or her face-up card in his or her hand. As implied above, this is necessary in some cases, in order to permit the play of a special-effects card. Also, as will be noted below, this is advantageous in some cases, because the face-up cards do not contribute to the meld in the preferred embodiment. Further, a player may wish to place a different card face-up, in order to minimize the advantage to another player who may play a special-effects card. Further, in the below-described alternative embodiment for drawing and discarding, a player may choose a different face-up card in order to minimize the advantage to any player who might take the face-up card as part of a regular draw.

During his or her turn, it has been described that a player has either drawn a card or cards, or has traded cards with other players, and/or has picked up his or her own face-up card. In the preferred embodiment, a player is required to place one card face-up on the common discard pile, and also have one card face-up at his station, in order to end his or her turn. Therefore, during a turn, a player may have three cards to add to his or her hand (two drawn and his or her face-up card) and is required to return two (one to the discard pile and one to his face-up station). This provides one mechanism for gathering the cards necessary to meld, or declare, the end of a round. Also described above is a second mechanism for altering the contents of a player's hand, i.e. the playing of a special-effects card.

However, variations on the draw and discard rules may be provided while still practicing the present invention. For example, it may be provided that each player may draw only one card, and need not discard to end his or her turn. Alternatively, it may be provided that each player is required to discard to his or her face-up station and not to the discard pile, and/or also permitting other players to draw from any other player's face-up stations. It is contemplated that there are a great variety of draw and discard rules, in combination with special-effects rules, that may be developed within the scope of the present invention.

In the preferred embodiment, a player's turn is ended after a draw, an optional pick-up and replacement of his or her own face-up card, and a discard. At the end of his or her turn, a player may declare the end of a round, if he or she is holding appropriate cards.

In the preferred embodiment, the conditions for melding, or declaring the end of the round, are that the player's hand, not including his or her face-up card, have at least four cards in matching combinations. That is, two cards each of two different values constitutes a total of four cards in matching combinations, and four cards of the same value also constitutes four cards in a matching combination. Further, in the preferred embodiment, the special-effects cards may not contribute to the meld. As noted above, each player's hand grows through the course of a round, so a player may have more than four cards in matching combinations, e.g. two Kings and three Princes is a qualifying meld.

Further, as the deck of cards in the preferred embodiment includes wild cards, the wild cards may be used to contribute to the meld. By way of example, a player holding one wild card, one card of one value and two cards matching of a different value would be permitted to declare the end of the round.

However, alternative rules for melding may be used while still practicing the present invention. The rules may permit a player to include his or her face-up card in the meld. Or, for example, the cards may be given a rank ordering, and runs in rank order may be used as alternatives or in addition to matching, in order to qualify for melding. That is, a player might qualify by having the combination of a "King-Queen-Prince" run and two "Throne" cards. Changing the total number of cards necessary to declare a round over, or including the face-up card in the meld, or requiring the presence of a "Right to declare" card (e.g. the presence of a special-effects card might be required, in the hand, to declare the round over, thereby providing a deterrent to its use as a trading weapon, or, in the alternative, a suitable quantity of distinct "right to declare" cards may be added to the deck) are additional variations on the melding rules that are contemplated to be within the scope of the present invention.

In the preferred embodiment, each player is permitted a final turn, after one player has declared the round over. This permits each player a last chance to draw and discard, and possibly improve his or her hand before point values are assigned. However, it is contemplated that the game according to the present invention can be practiced wherein the rules do not permit each player to have a final turn after one player has declared the round over.

After a round is over, point values are assigned to each player. In general, positive point values are assigned for matching combinations of cards, and negative point values are assigned for holding unmatched cards. Further, higher point values are assigned for having more than two cards of a given value, i.e. three of a kind earns more points than two of a kind, and four of a kind earns more points than three of a kind. Also, in the preferred embodiment, the player who declared the round over is given points for making the declaration.

More particularly, in the preferred embodiment, five points are assigned for declaring, each pair of matching cards is assigned one point, three of a kind is assigned five points, and four of a kind is assigned ten points. Also, each unmatched card in the hand is assigned a value of negative one point. In the preferred embodiment, only the cards in each player's hand are involved in the assignment of points. That is, the face-up cards are not involved in the assignment of points.

However, alternative schemes for assigning points to each player at the end of a round may be used, while practicing the game of the present invention. The rules may require the inclusion of the face-up card in the assignment of points, or may provide that certain card values be assigned greater points than others, or may provide that certain card values are assigned heavily negative points.

In the preferred embodiment, a game comprises more than one round. More particularly, in the preferred embodiment, a number of rounds are played until one player accumulates 20 or more points.

In the preferred embodiment, the dealer has the fewest number of trading options in the first turn. Therefore, in order to distribute this disadvantage, the deal is passed from one player to the next in rotation, as play progresses from one round to the next.

However, alternative rules for ending the game and declaring a winner may be used, while practicing the game according to the present invention. The game may be played for a predetermined number of rounds.

Also, the rules for determining who deals next and who goes first in rotation may be based on who has the lowest (or highest) score so far, or on who had the highest (or lowest) score on the previous round, rather than being based on who is next in the rotation.

The specification necessarily discloses specific structural and rules arrangements embodying the invention. However, it will be appreciated that the invention can be practiced in various forms and structural combinations.

The present invention, described above, relates to a melding card game. Features of the present invention are recited in the appended claims. The specification contained herein necessarily depicts structural features and embodiments of the melding card game, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical, electronic and functional equivalents to the above, which may be obvious to those skilled in the arts pertaining thereto, are considered to be encompassed within the claims of the present invention.

What I claim is:

1. A method of playing a melding card game comprising the following steps:

a) providing a deck of playing cards including a plurality of different melding card values and having a plurality of cards of each melding card value, and including one or more special-effects cards;

b) dealing a plurality of cards face-down to each player;

c) dealing at least one card face-up to each player;

d) placing the remaining deck face-down and turning at least one card from the remaining deck face-up to begin a common discard pile;

e) beginning a round wherein each player in rotation has a first turn where each player is allowed to trade a card according to a first set of rules;

f) playing subsequent turns where each player in rotation is allowed to draw and discard according to a second set of rules, where the second set of rules specifies:

i) the use of the special-effects card, where the player of a special-effects card is required to take a card from each of the other players then return a card to each of the other players, and ii) the conditions whereby one player may end the round, where the conditions for ending the round includes a requirement for holding a certain combination of cards; and g) after the round is ended, assigning point values to is each player according to a set of point-assignment rules.

2. A method of playing a melding card game, as described in claim 1, wherein:

the rules for playing the first turn may limit each player to trade only a face-up card or only a face down card, or may permit each player to trade any card;

the rules for playing the first turn may limit each player to take only a face-up card or only the top card of the common discard pile or only a face-up card that matches a card in the players hand, or may permit each player to take any card;

the rules for playing the first turn forbid each player from taking the face-up card of any player preceding him or her in the rotation when the earlier player has traded his or her face-up card;

the rules for playing the second and subsequent turns specify that each player may take at least one card from the common discard pile and/or take at least one card from the remaining deck, or if a player has a special-effects card, it may be played instead of taking a card;

the rules require each player to have one card face-up and to discard another card face-up, not necessarily to the common discard pile, in order to end his or her turn;

the rules specify that a player may end the round after ending his or her turn, by having at least two pairs of matching melding cards; and the point assignment rules are applied to every player, and give positive value for the presence of matching melding cards and give negative value for the presence of unmatched melding cards.

3. A method of playing a melding card game, as described in claim 2, but wherein the rules for playing the first turn specify that each player may trade only his or her face-up card for the face-up card of another player or for the top card of the common discard pile, and where a player may not trade his or her face-up card for the face-up card of any player preceding him or her in the rotation;

wherein the rules specify that each player must discard to the top of the common discard pile in order to end his or her turn; and wherein the rules specify that no player may use his or her face-up card for melding.

4. A method of playing a melding card game, as described in claim 3, wherein the deck of playing cards further includes one or more wild cards; and wherein the wild cards may be used to satisfy the conditions for ending the round.

5. A method of playing a melding card game, as described in claim 3, wherein the rules for playing the second and subsequent turns permit a player to take his or her own face-up card and replace it with a card from his or her hand before ending his or her turn; and wherein a player may not play a special-effects card from the face-up position.

6. A method of playing a melding card game, as described in claim 3, wherein the deck of playing cards further includes one or more wild cards and the wild cards may be used to satisfy the conditions for ending the round;

wherein the rules for playing the second and subsequent turns permit a player to take his or her own face-up card and replace it with a card from his or her hand before ending his or her turn, and wherein a player may not play a special-effects card from the face-up position; and wherein the rules specify that after one player has satisfied the conditions for ending the round, each other player is allowed one final turn before the assigning of point values.

7. A method of playing a melding card game, as described in claim 6, wherein the deck of playing cards includes ten or more melding card values, and has four or more cards of each value;

wherein the rules for playing the second and subsequent turns require a player to begin each subsequent turn by taking two or more cards from a combination of the remainder of the deck and the common discard pile or by playing a special-effects card;

wherein the rules specify that a player may end the round after ending his or her turn, by having four or more cards in the meld, for example two pairs, or three of a kind and one pair, or four of a kind; and wherein the point assignment rules give more value to three of a kind than to a pair, and more value to four of a kind than to three of a kind.

8. A method of playing a melding card game, as described in claim 2, wherein the deck of playing cards further includes one or more of wild cards; and wherein the wild cards may be used to satisfy the conditions for ending the round.

9. A method of playing a melding card game, as described in claim 2, wherein the rules for playing the second and subsequent turns permit a player to take his or her own face-up card and replace it with a card from his or her hand before ending his or her turn; and wherein a player may not play a special-effects card from the face-up position.

10. A kit for playing a melding card game comprising:

a deck of playing cards including a plurality of different melding card values and having a plurality of cards of each melding card value, and including one or more special-effects cards; and a set of instructions for playing a melding card game, wherein the instructions specify a) dealing a plurality of cards face-down to each player;

b) dealing at least one card face-up to each player;

c) placing the remaining deck face-down and turning one card from the remaining deck face-up to begin a common discard pile;

d) beginning a round wherein each player in rotation has a first turn where each player is allowed to trade a card according to a first set of rules;

e) playing subsequent turns where each player in rotation is allowed to draw and discard according to a second set of rules, where the second set of rules specifies:

i) the use of the special-effects card, where the player of a special-effects card is required to take a card from each of the other players then return a card to each of the other players, and ii) the conditions whereby one player may end the round, where the conditions for ending the round includes a requirement for holding a certain combination of cards; and f) after the round is ended, assigning point values to each player according to a set of point-assignment rules.

11. A kit for playing a melding card game, as described in claim 10, wherein the instructions for playing the first turn may limit each player to trade only a face-up card or only a face down card, or may permit each player to trade any card;

the instructions for playing the first turn may limit each player to take only a face-up card or only the top card of the common discard pile or only a face-up card that matches a card in the players hand, or may permit each player to take any card;

the instructions for playing the first turn forbid each player from taking the face-up card of any player preceding him or her in the rotation when the earlier player has traded his or her face-up card;

the instructions for playing the second and subsequent turns specify that each player may take at least one card from the common discard pile and/or take at least one card from the remaining deck, or if a player has a special-effects card, it may be played instead of taking a card;

the instructions require each player to have one card face-up and to discard another card face-up, not necessarily to the common discard pile, in order to end his or her turn;

the instructions specify that a player may end the round after ending his or her turn, by having at least two pairs of matching melding cards; and the point assignment rules are applied to every player, and give positive value for the presence of matching melding cards and give negative value for the presence of unmatched melding cards.

12. A kit for playing a melding card game, as described in claim 11, but wherein the instructions for playing the first turn specify that each player may trade only his or her face-up card for the face-up card of another player or for the top card of the common discard pile, and where a player may not trade his or her face-up card for the face-up card of any player preceding him or her in the rotation;

wherein the instructions for playing the second and subsequent turns specify that the player of a special-effects card may take the face-up card of at least one other player;

wherein the instructions specify that each player must discard to the top of the common discard pile in order to end his or her turn; and wherein the instructions specify that no player may use his or her Lace-up card for melding.

* * * * *